United States Patent [19]

Hull et al.

[11] Patent Number: 4,879,766

[45] Date of Patent: Nov. 14, 1989

[54] BRASSIERE AND/OR ATTACHMENT

[76] Inventors: Harold L. Hull, 401 Sp. 43, Sparks, Nev. 89431; Althea P. Tafte, 2760 S. Virginia, Sp. 17, Reno, Nev. 89502

[21] Appl. No.: 164,802

[22] Filed: Mar. 7, 1988

[51] Int. Cl.[4] ..... A41C 3/00

[52] U.S. Cl. ..... 2/101; 223/111; 450/1

[58] Field of Search ..... 223/111; 450/1, 7, 14, 450/15, 20; 2/101, 112

[56] References Cited

U.S. PATENT DOCUMENTS

| | | | |
|---|---|---|---|
| 462,555 | 11/1891 | Hoyt | 2/101 |
| 900,728 | 10/1908 | Harris | 2/112 |
| 1,067,289 | 7/1913 | Volk | 450/7 |
| 1,375,188 | 4/1921 | Stern | 2/112 |
| 1,420,728 | 6/1922 | Moore | 2/112 |
| 1,454,417 | 5/1923 | Warner | 450/20 |
| 1,482,321 | 1/1924 | Roye | 2/112 |
| 1,486,779 | 3/1924 | Mayer | 450/7 |
| 1,672,770 | 6/1928 | Mountain | 2/112 |
| 1,756,809 | 4/1930 | Brennan | 450/7 |
| 1,760,247 | 5/1930 | McKenzie | 450/7 |
| 2,052,163 | 8/1936 | Brown | 450/20 |
| 2,140,273 | 12/1938 | Simon | 450/20 |
| 2,511,809 | 6/1950 | Ryan | 2/112 X |
| 2,525,666 | 10/1950 | Glynn | 450/14 |
| 2,620,480 | 12/1952 | Shea | 2/112 X |
| 2,724,835 | 11/1955 | Connors | 2/112 |
| 3,027,898 | 4/1962 | Williams | 128/510 |
| 3,149,635 | 9/1964 | Garutso | 128/460 |
| 3,179,109 | 2/1965 | Born | 128/507 |
| 3,430,632 | 3/1969 | Etal | 128/425 |
| 4,072,255 | 2/1978 | Bogorad | 223/111 |
| 4,202,343 | 5/1980 | Ichelson | 450/14 |

FOREIGN PATENT DOCUMENTS

| | | | |
|---|---|---|---|
| 637652 | 3/1962 | Canada | 2/112 |

*Primary Examiner*—Werner H. Schroeder
*Assistant Examiner*—Jeanette E. Chapman

[57] ABSTRACT

A brassiere or article of clothing such as a bathing suit top having sufficient elasticity to permit donning thereof when the article or clothing is snaped together or closed before putting on, by stepping thereinto or by slipping over the shoulders and means thereby of pulling into place by means of a strap in the back portion and/or loops in the front portion.

4 Claims, 1 Drawing Sheet

BRASSIERE AND/OR ATTACHMENT

BACKGROUND OF THE INVENTION

Brassieres that are one piece construction or are fastened together before donning are difficult to pull into place especially if the person donning said garment is handicapped or has limited use of arms and hands such as can occur with old age or arthritic persons. Prior art has not addressed this problem directly and to the knowledge of the inventors no means have been provided for the person donning said garment to pull the grament into place without help from someone else.

SUMMARY OF THE INVENTION

This invention relates to brassieres or article of clothing such as a bathing top having sufficient elasticity to permit donning thereof when the article of clothing is snaped or fastened together or closed before pulling on by slipping over the shoulders or by stepping into and means thereby of pulling said garment into place by means of a strap in the back portion and/or loops in the front portion.

A construction design to carry out the invention will be hereinafter described, together with other features of the invention.

The invention will be more readily understood from a reading of the following specifications and by reference to the accompanying drawings, wherein examples of the invention are shown, and wherein.

Figure 1:
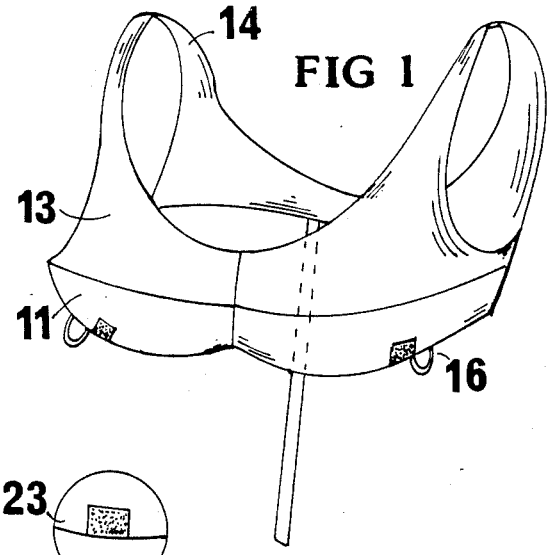
FIG. 1 is a front perspective view of a brassiere constructed in accordance with the invention.
Figure 2:
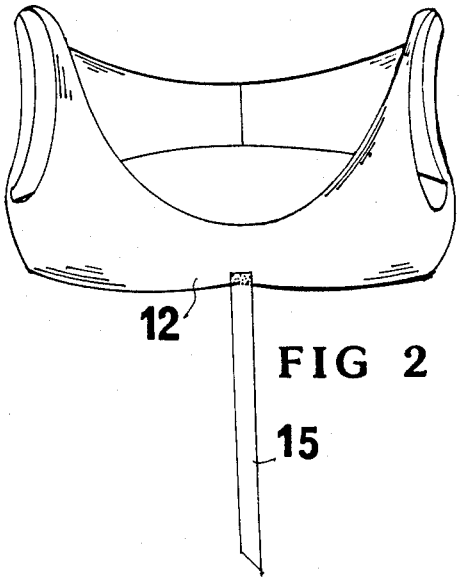
FIG. 2 is a rear perspective of the brassiere.

In all general aspects, the brassiere generally indicated at FIG. 1 and 2 is to be regarded merely as illustrative of various types and forms of conventional brassieres.

Merely as illustrative, the brassiere in FIG. 1 and 2 is shown to comprise a body portion 10, including a front section, 11, and a back section, 12, with the front section, 11, being formed of a pair of cup portions, 13, and back and front sections being joined by shoulder straps, 14. This invention relates particularly to the addition of strap, 15, which is attached to the back section, 12, as shown and loops, 16, attached to the front section, 11.

Figure 3:
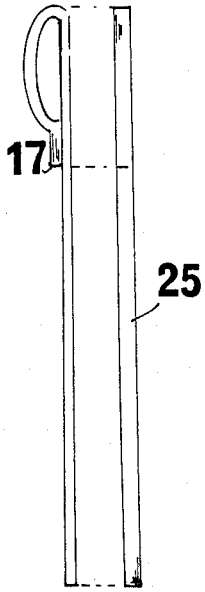
FIG. 3 is an attachable strap.

FIG. 3, shows an independent strap, 25, which may be attached to any garment by one of many conventional means, 17, such as a snap, a loop and pile fastener such as VELCRO, safety pen, etc.

Figure 4:
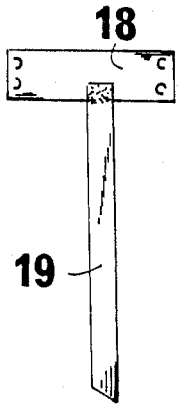
FIG. 4 is attachable section with strap.

FIG 4, shows a section, 18, which is an extension to said back section, 12, which has a strap, 19, affixed to it as shown.

Figure 5:
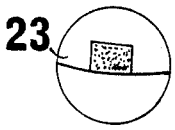
FIG. 5 are sewn-in loops.

FIG. 5, shows loops built on the underside of the garment next to the body and affixed top and bottom, 23, by sewing or other means, thus leaving a loop at 24.

Figure 6:
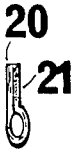
FIG. 6 are attachable loops.

FIG. 6, shows loops, 20, being attachable to any garment by means, 21, at the top end, such as a snap, a loop and pile fastener such as VELCRO, safety pin, etc. and this enbodiment shows loops being attached to the front section, 11, of brassiere, 10.

It will be readily seen that by the additions of a strap, 15, 25, or 19, and/or the addition of loops, 16, or 24, that after the garment has been pulled on that the garment may be pulled into place by reaching behind the waist and pulling on the strap 15, 25, or 19, and by hooking the thumbs or one finger into the loops 16 or 24. The strap may now be tucked into the garment on the side or front to be out of the way if desired. This invention allows a disabled or person with limited agility to completely put on the brassiere and pull it into place without the necessity of another persons help, thus furthering their independence and dignity.

What we claim and desire to secure by letters patent is:

1. A brassiere comprising;

(a) a front section having a pair of breast supporting cups;

(b) a pair of shoulder strap portions;

(c) a back section;

(d) a plurality of loops fixed to the bottom edge of the front section suitable for the insertion of a thumb or finger and (e) a pull strap affixed to substantially the center of the said back section with its free end being free of all obstructions to allow said end to be tucked underneath the side or front edge of the brassiere and being of sufficient length to enable the wearer to reach it and to pull said brassiere into place.

2. The brassiere of claim 1 in which the means to affix the plurality of loops to the bottom edge of the front section are of the loop and pile type such as VELCRO.

3. The brassiere of claim 1 in which the means to affix the pull strap to the substantially center of the back section is of the loop and pile type such as VELCRO.

4. The brassiere of claim 1 in which the pull strap has a loop at its free end, said loop being suitable for the insertion of the thumb or finger of the wearer before the donning of the garment to enable said wearer to pull said garment into place after the garment has been put on.

* * * * *